United States Patent [19]

Rohlfs

[11] 4,057,938

[45] Nov. 15, 1977

[54] PORTABLE SAND BLASTING DEVICE

[76] Inventor: John H. Rohlfs, 1955 Torringford West St., Torrington, Conn. 06790

[21] Appl. No.: 697,013

[22] Filed: June 17, 1976

[51] Int. Cl.[2] ..... B21J 13/00

[52] U.S. Cl. ..... 51/429; 51/432

[58] Field of Search ..... 51/8 R, 8 H, 9 R, 11, 51/12

[56] References Cited

U.S. PATENT DOCUMENTS 3,491,563 1/1970 Alonso ..... 51/9

*Primary Examiner*—Al Lawrence Smith
*Assistant Examiner*—Robert C. Watson
*Attorney, Agent, or Firm*—McCormick, Paulding & Huber

[57] ABSTRACT

A portable sand blasting device comprising a housing adapted to be held and manipulated manually and to support an electric motor having a rotatable output shaft. An impeller is mounted on the motor output shaft and has an inlet opening communicating with an inlet chamber which receives air and entrained sand through a conduit extending to a sand pouch adapted to be carried on the body of the operator. The impeller also has a plurality of radial passageways each of a generally circular configuration but with a somewhat "V"-shaped trailing wall. A spiral discharge chamber receives the air and entrained sand from outer end of the impeller passageways and conducts the same to a discharge opening and an associated nozzle. The spiral discharge chamber has a "V"-shaped outer wall with the open end of the "V" facing the impeller. An annular series of small apertures in a housing member adjacent the impeller inlet chamber provides for the entry of additional ambient air and a rotatable disc thereabove has a similar annular series of apertures. The disc may be rotated to align and to misalign the apertures in varying degrees whereby to regulate air flow.

29 Claims, 7 Drawing Figures

PORTABLE SAND BLASTING DEVICE

BACKGROUND OF THE INVENTION

Sand blasting devices presently available are generally satisfactory but portability is found lacking. Moreover, a supply of compressed air is required in the operation of such devices and air compressors are not readily available in many instances as for example, in the case of residential use.

SUMMARY OF THE PRESENT INVENTION

It is the general object of the present invention to provide a portable sand blasting device which is relatively simple in its construction and operation and which yet provides a high degree of dependability and durability in use, and which is adapted further to operate from an electrical power source without the need for a supply of air under pressure.

DESCRIPTION OF THE PREFERRED EMBODIMENT

Figure 1:
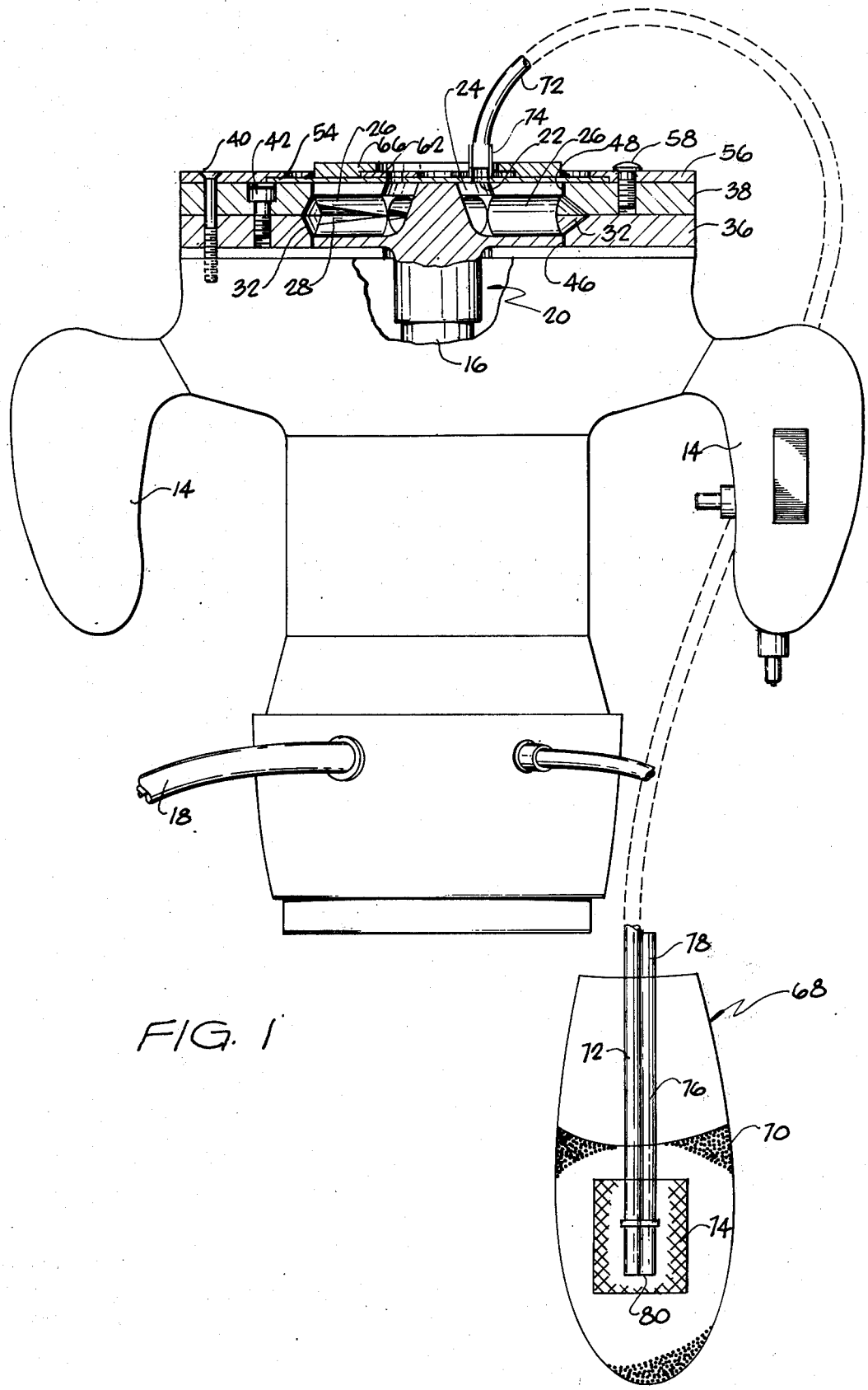
FIG. 1 of the drawings is an elevational view of the portable sand blasting device of the present invention, portions thereof being broken away for clarity of illustration.

Referring particularly to FIG. 1, it will be observed that a portable sand blasting device is indicated generally by the reference numeral 10. A housing 12 of the sand blasting device is generally cylindrical in form and is adapted to be held and manipulated manually. As illustrated, the housing has oppositely disposed handles 14,14 respectively for the left and right hand of the operator. Disposed within the housing and supported thereby is a conventional electric motor with a rotatable output shaft 16 which projects upwardly within an upper portion of the housing. The electric motor has an associated electrical conductor means in the form of a cord 18 for connecting the same with a source of electrical power. While the invention is not so limited, the housing, handles and motor may take the form of identical units found in conventional portable routers. The working router elements mounted on or attached to the shaft 16 are of course removed in conversion to a portable sand blasting device.

Figure 4:
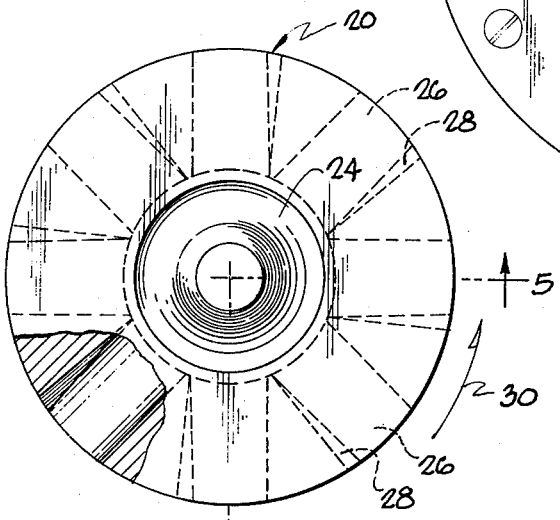
FIG. 4 is a top view of an impeller of the present invention, portions thereof being broken away for clarity of illustration.
Figure 5:
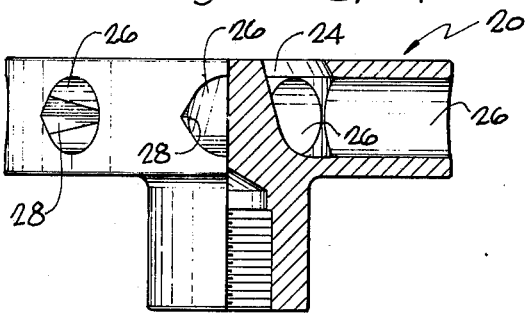
FIG. 5 is a side view of the impeller of FIG. 4 partially in section as indicated by the lines 5—5 in FIG. 4.

An air and sand impeller 20 is mounted on the shaft 16 in accordance with the present invention and while there may be substantial variation in impeller form, an axial inlet-radial flow impeller is presently preferred. That is, the impeller 20 has an inlet opening 22 which introduces air and entrained sand axially to an inlet chamber 24 defined by and within an upper portion of the impeller. The inlet chamber 24 is generally annular in form and communicates with at least one air and sand passageway formed in the impeller. As illustrated, the impeller has a plurality of circumaxially arranged and radially extending passageways, FIGS. 1, 4 and 5. Eight such passageways 26,26 are preferably provided and each passageway may have a generally circular cross section as illustrated. A refinement in passageway construction involves the provision of a generally "V"-shaped trough or groove 28 in the trailing wall of each passageway, the impeller being rotated in a counter-clockwise direction in FIG. 4 as indicated by arrow 30. Each groove 28 extends radially along its passageway wall and, in its progression radially outwardly, becomes somewhat deeper and broader, FIGS. 1, 4 and 5. Sand entrained in air introduced to the impeller at the inlet opening 22 and passing through the inlet chamber 24 and the passageways 26,26 tends to collect in the grooves 28,28 and efficiency in the operation of the device is thus enhanced.

Figure 3:
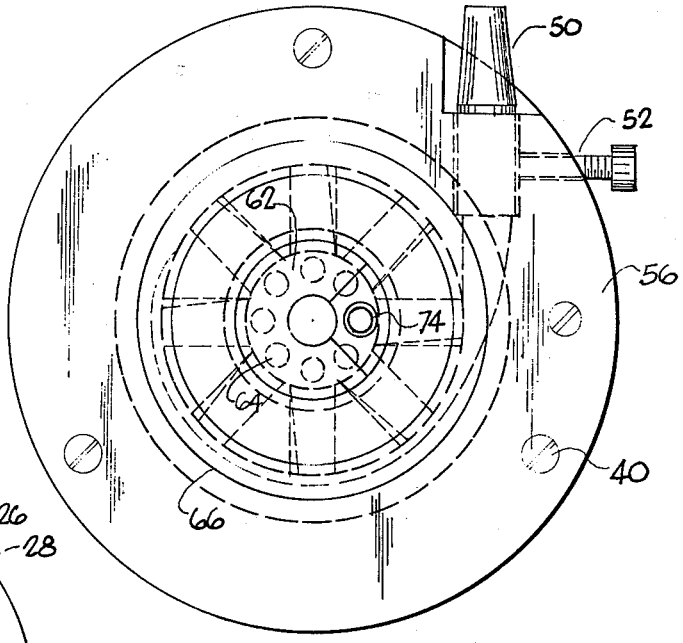
FIG. 3 is a top view of the sand blasting device of the present invention.
Figure 6:
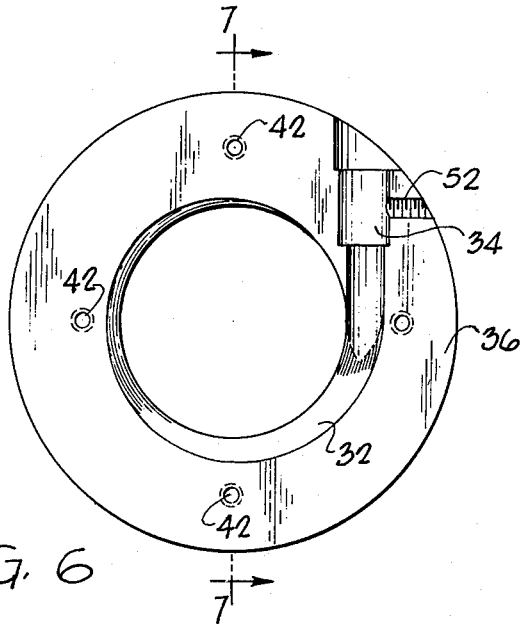
FIG. 6 is a top view of a cylindrical plate forming a part of the housing of the sand blasting device and partially defining a spiral discharge chamber and discharge opening.
Figure 7:
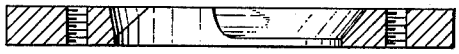
FIG. 7 is a sectional view of the disc of FIG. 6 taken generally as indicated by the lines 7—7 in FIG. 6.

A discharge chamber for the impeller is also provided in accordance with the presently preferred practice and takes an arcuate form extending at least partially around and adjacent the periphery of the impeller. As illustrated, a discharge chamber 32 has a spiral configuration, FIGS. 3 and 6, and the chamber cross sectional area increases in counter-clockwise progression toward a discharge opening 34. Further, the discharge chamber 32 is preferably provided with a generally "V"-shaped cross sectional configuration viewed tangientially with the apex of the "V" spaced radially outwardly from the impeller periphery and with the "V" opening toward the impeller. Still further, the "V"-shaped outer wall of the chamber 32 becomes somewhat deeper and thus sharper in progression toward the discharge opening 34.

The function served by the "V"-shaped configuration of the discharge chamber 32 is similar to that of the "V"-shaped grooves 28,28 in the impeller passageways 26,26. That is, sand thrown outwardly from the impeller passageways 26,26 tends to collect in the "V" of the "V"-shaped wall and efficiency of operation is thus enhanced.

The manner in which the housing is formed in the area adjacent the impeller 20 may vary widely within the scope of the invention. As presently preferred, similar lower and upper flat cylindrical housing plates 36,38 are employed and the said plates are secured in position on the housing proper as by means of a plurality of retaining screws 40,40. Further, a plurality of retaining screws 42,42 may be employed to secure the plates 36,38 in face-to-face relationship. The spiral discharge chamber 32 is formed at inner walls of the plates 36,38 with approximately one half (½) of the chamber being formed in each of the plates, FIG. 6. That is, circular central openings 46,48 in the plates 36,38 receive and house the impeller 20 and the discharge chamber 32 is formed in the walls of the openings. Preferably, the impeller 20 and the plates 36,38 are formed of hardened material or, alternatively, hard coatings may be applied in the areas of sand engagement and wear.

Referring again to FIGS. 3 and 6, it will be observed that the discharge opening 36 takes a generally cylindrical cross sectional shape and is arranged along a centerline which extends substantially tangentially with respect to the impeller 20. A nozzle means of nozzle 50 is adapted to enter and fit the discharge opening 34 and thus to receive and discharge air and entrained sand in a high speed stream for a blasting operation. A set screw 52 may be provided to secure the nozzle 50 in position.

With the particular arrangement illustrated, it will be observed that the high speed discharge of a sand spray results at least in part from entrainment of the sand in a high speed stream of air. Further, it is to be observed that the sand is physically thrown or ejected from the passageways 26,26 as the individual passageways approach and pass the discharge opening 34. A component of movement of each sand particle, collected in a passageway 26 and groove 28, is at least approximately tangential as the sand leaves the discharge end of the groove. Such component of movement causes the sand to be thrown or ejected outwardly through the discharge opening 34 and nozzle 50 or in the alternative, the sand may engage the outer wall of the discharge chamber 32 of the discharge opening 34 and thus be deflected outwardly through the nozzle. The formation of the outer wall of the discharge chamber 32 and the discharge opening 34 at their area or zone of junction is such that a smooth blending contour is achieved.

From the foregoing, it will be apparent that a relatively high speed operation of the impeller 20 is to be desired. The electric motor in the router unit presently employed operates in a speed range of 19,000 to 20,000 RPM and excellent results have been achieved with impeller speeds in this range.

Figure 2:
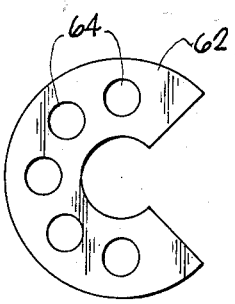
FIG. 2 is a top view of an apertured rotatable disc forming a part of the sand blasting device.

Still further, it has been found that an additional supply of ambient air to the impeller substantially enhances the efficiency of operation of the device. Accordingly, at least one additional ambient air inlet opening is provided for the impeller independently of the aforementioned air and sand inlet opening 22. Such additional opening may take various forms but in the presently preferred form, air flow adjustment is provided for and an apertured disc 54 is mounted atop the plate 38 by means of a thin annular retainer member 56. The member 56 is in turn secured in position by a plurality of screws 58,58 threadably entered in suitable openings in the plate 38. The disc 54 has an annular series of small openings 60,60 (7 shown) and each communicating with the impeller inlet chamber 24 and exposed upwardly for the entry of surrounding air. Mounted atop the disc 54 is a smaller diameter rotatable disc 62 similarly provided with an annular series of small openings 64,64 (5 shown), FIG. 2. The disc 62 is secured in position by means of a thin flat annular retainer 66 which may be welded or otherwise secured in position atop the disc 54.

As will be apparent, the openings 60,60 and the openings 64,64 provide through openings for the introduction of ambient air to the impeller inlet chamber 24. With the disc 62 rotated to a position of exact alignment of the openings 60,60 and 64,64 a maximum flow of ambient air is provided for. On rotation of the disc misaligning the openings in varying degree adjustment of the flow of ambient air can be readily achieved.

A supply of air and entrained sand to the aforementioned inlet opening 22 may be conveniently provided from a receptacle 68 in the form of a sand pouch adapted to be carried on the body of the operator of the sand blasting device. Sand disposed in the pouch at 70 surrounds an inlet end of a conduit means 72 in the form of an elongated flexible tube. The tube 72 extends from the sand to a fitting 74 at its discharge end adjacent the impeller inlet opening 22. Preferably, a sand screen 74 is provided about the inlet end of the sand supply tube 72 and a short length of similar tubing 76 serves as an air inlet conduit means. That is, the tube 76 has an upper end portion 78 which is exposed to ambient air and a lower end portion 80 is disposed in the sand adjacent the inlet end of the tube 72. On operation of the sand blasting device, the sand in the pouch adjacent the lower ends of the tubes 72,76 is sufficiently disturbed and intermixed with the air flowing downwardly through the tube 76 so as to cause the entrainment of sand particles in the air stream flowing within the tube 72 to the impeller inlet. A substantial suction is achieved with the high speed impeller operation as mentioned above.

The sand blasting device of the present invention is highly efficient in operation and, while operation is not understood to the point of certainty, it is believed that a jet pump effect may be achieved in the inlet chamber 24 adjacent the air and sand inlet opening 22. That is, the air flowing into the chamber 24 from the ambient air inlet openings 60,60 and 64,64 passes the inlet opening 22 at a high rate of speed in its progress to the inlet ends of the impeller passageways 26,26. A lowered pressure may thus be provided at the inlet 22 and throughout the length of the flexible supply tube 72 to the sand in the pouch 68.

From the foregoing, it will be apparent that a relatively simple construction has been provided for a portable sand blasting device. Operation of the device is convenient to the user as he may simply grasp the handles 14,14 and direct or aim the device and its nozzle 50 bodily toward the workpiece to be blasted. Control over nozzle direction and the blasting stream is thus readily achieved. There is no need for a supply of compressed air and instead, a radially available electrical power source may be employed. Finally, portability is enhanced in the provision of the pouch 68 which can be carried on the body of the operator and readily moved about as the blasting device is manipulated to difficult and otherwise inaccessible areas.

I claim:

1. A portable sand blasting device comprising a housing adapted to be held and manipulated manually, an electric motor supported by the housing and having a rotatable output shaft, electrical conductor means for connecting the motor to a source of electrical power, a high speed air and sand impeller mounted on the motor output shaft and having inlet and discharge openings respectively for receiving and discharging air and entrained sand and at least one air and sand passageway interconnecting said inlet and discharge openings, at least one additional air inlet opening for said impeller, nozzle means arranged to receive air and entrained sand from said discharge opening and to discharge a high speed stream of air and sand for a blasting operation, a sand receptacle for holding a supply of sand, and air and sand supply conduit means connected between sand in said receptacle and said impeller inlet opening.

2. A portable sand blasting device as set forth in claim 1 wherein means is provided for adjusting the size of said additional inlet opening and thereby changing the rate of air flow therethrough.

3. A portable sand blasting device as set forth in claim 2 wherein two adjacent and relatively movable apertured members are provided with the through opening of the apertures serving as said additional impeller inlet opening, relative movement between the members resulting in a changed area of said through opening and in inlet opening and air flow adjustments as aforesaid.

4. A portable sand blasting device as set forth in claim 3 wherein said relatively movable members take the form of a fixed housing member having an annular series of small apertures and a rotatable disc having a similar annular series of small apertures, said disc being rotatable to align cooperating apertures for maximum inlet opening and air flow, and rotatable further to positions of misalignment of said cooperating apertures in varying degree for conditions of reduced inlet opening and air flow.

5. A portable sand blasting device as set forth in claim 1 wherein said impeller includes an inlet chamber for receiving air and entrained sand from said inlet opening, and wherein said impeller also includes a plurality of passageways extending generally radially outwardly from said inlet chamber toward said discharge opening, said impeller passageways serving both to impell air and entrained sand and physically to engage sand particles and throw the same toward said discharge opening.

6. A portable sand blasting device as set forth in claim 5 wherein at least part of said discharge opening is arranged generally in tangential relationship with respect to said impeller.

7. A portable sand blasting device as set forth in claim 6 wherein said housing defines an arcuate discharge chamber extending at least partially about said impeller and communicating with said impeller passageways.

8. A portable sand blasting device as set forth in claim 7 wherein said discharge chamber has a generally spiral configuration viewed along the axis of the impeller, the chamber cross sectional area increasing in progression toward the discharge opening and nozzle means.

9. A portable sand blasting device comprising a housing adapted to be held and manipulated manually, an electric motor supported by the housing and having a rotatable output shaft, electrical conductor means for connecting the motor to a source of electrical power, a high speed air and and impeller mounted on the motor output shaft and having inlet and discharge openings respectively for receiving and discharging air and entrained sand and at least one air and sand passageway interconnecting said inlet and discharge openings, said impeller including a central inlet chamber for receiving air and entrained sand from said inlet opening, and said impeller passageway extending generally radially outwardly from said inlet chamber toward said discharge opening, said impeller passageway serving both to impell air and entrained sand and physically to engage sand particles against its wall and throw the same toward said discharge opening, nozzle means arranged to receive air and entrained sand from said discharge opening and to discharge a high speed stream of air and sand for a blasting operation, a sand receptacle for holding a supply of sand, and air and sand supply conduit means connected between sand in said receptacle and said impeller inlet opening.

10. A portable sand blasting device as set forth in claim 9 wherein at least part of said discharge opening is arranged generally in tangential relationship with respect to said impeller.

11. A portable sand blasting device as set forth in claim 10 wherein said housing defines an arcuate discharge chamber extending at least partially about said impeller and communicating with said impeller passageway and said discharge opening respectively to receive and to discharge air and entrained sand.

12. A portable sand blasting device as set forth in claim 11 wherein said discharge chamber has a generally spiral configuration viewed along the axis of the impeller, the chamber area increasing in progression toward the discharge opening and nozzle means.

13. A portable sand blasting device as set forth in claim 12 wherein said discharge chamber has a generally "V"-shaped cross sectional configuration viewed tangentially with the apex of the "V" spaced radially outwardly from the impeller periphery and the open end of the "V" facing the impeller.

14. A portable sand blasting device as set forth in claim 13 wherein said discharge chamber "V" configuration becomes sharper in progression toward said discharge opening.

15. A portable sand blasting device as set forth in claim 14 wherein said discharge opening and nozzle means have a generally cylindrical configuration with the apex of the "V"-shaped spiral discharge chamber blending smoothly with the wall of said discharge opening.

16. A portable sand blasting device as set forth in claim 9 wherein said impeller has a plurality of circumaxially spaced radial passageways each extending from said impeller inlet chamber toward said discharge opening.

17. A portable sand blasting device as set forth in claim 16 wherein each of said impeller passageways has a generally cylindrical cross sectional configuration.

18. A portable sand blasting device as set forth in claim 17 wherein a trailing side wall of each of said impeller passageways has a generally "V"-shaped radially extending groove therein.

19. A portable sand blasting device as set forth in claim 18 wherein each of said "V"-shaped grooves in said impeller passageways becomes progressively deeper and broader as it progresses radially outwardly along its respective passageway wall.

20. A portable sand blasting device as set forth in claim 9 wherein said sand receptacle takes the form of a pouch adapted to be secured to the body of the operator of the device.

21. A portable sand blasting device as set forth in claim 9 wherein said air and sand conduit means is adapted at its inlet end to enter and to be buried in sand in said receptacle, and wherein a screening device is provided and operatively associated with said inlet end of said conduit means.

22. A portable sand blasting device as set forth in claim 21 wherein an air inlet conduit is provided and has an exposed inlet end and a discharge end disposed in the sand in the receptable adjacent the inlet end of said air and sand conduit means.

23. A portable sand blasting device as set forth in claim 9 wherein said electric motor operates approximately in the speed range of 19,000 - 20,000 RPM.

24. A portable sand blasting device comprising a housing adapted to be held and manipulated manually, an electric motor supported by the housing and having a rotatable output shaft, electrical conductor means for connecting the motor to a source of electrical power, a high speed air and sand impeller mounted on the motor output shaft and having inlet and discharge openings respectively for receiving and discharging air and entrained sand and a plurality of generally radial air and sand passageways interconnecting said inlet and discharge openings, said passageways each communicating continuously with said inlet opening, nozzle means arranged to receive air and entrained sand from said discharge opening and to discharge a high speed stream of air and sand for a blasting operation, a sand receptacle for holding a supply of sand, and air and sand supply conduit means connected at its discharge end with said impeller inlet opening and having its inlet end in said receptacle whereby to create a suction sufficient to draw air and entrained sand through the conduit means.

25. A portable sand blasting device comprising a housing adapted to be held and manipulated manually, an electric motor supported by the housing and having a rotatable output shaft, electrical conductor means for connecting the motor to a source of electrical power, a high speed air and sand impeller mounted on the motor output shaft and having inlet and discharge openings respectively for receiving and discharging air and entrained sand and a plurality of generally radial air and sand passageways interconnecting said inlet and discharge openings, said passageways each communicating continuously with said inlet opening, nozzle means arranged to receive air and entrained sand from said discharge opening and to discharge a high speed stream of air and sand for a blasting operation, a sand receptacle for holding a supply of sand, air and sand supply conduit means connected between sand in said receptacle and said impeller inlet opening, and means providing for an air flow to said impeller to supplement the air flow through said supply conduit means.

26. A portable sand blasting device as set forth in claim 25 and including means for adjusting said supplementary air flow.

27. A sand blasting device as set forth in claim 25 and including means providing for an air flow to supplement the air flow through said supply conduit means.

28. A sand blasting device as set forth in claim 27 and including means for adjusting said supplementary air flow.

29. A sand blasting device comprising a housing, an electric motor supported by the housing and having a rotatable output shaft, electrical conductor means for connecting the motor to a source of electrical power, a high speed air and sand impeller mounted on the motor output shaft and having inlet and discharge openings respectively for receiving and discharging air and entrained sand and a plurality of generally radial air and sand passageways interconnecting said inlet and discharge openings, said passageways each communicating continuously with said inlet opening, nozzle means arranged to receive air and entrained sand from said discharge opening and to discharge a high speed stream of air and sand for a blasting operation, a sand receptacle for holding a supply of sand, and air and sand supply conduit means connected at its discharge end with said impeller inlet opening and having its inlet end in said receptacle whereby to create a suction sufficient to draw air and entrained sand through the conduit means.

* * * * *